United States Patent [19]

House

[11] Patent Number: 4,554,414

[45] Date of Patent: Nov. 19, 1985

[54] MULTI-DRIVER LOUDSPEAKER

[75] Inventor: William N. House, Bloomington, Ind.

[73] Assignee: Harman International Industries Incorporated, Northridge, Calif.

[21] Appl. No.: 565,464

[22] Filed: Dec. 27, 1983

Related U.S. Application Data

[63] Continuation-in-part of Ser. No. 489,322, Apr. 28, 1983, , which is a continuation-in-part of Ser. No. 383,603, Jun. 1, 1982.

[51] Int. Cl.[4] ..... H04R 1/24; H04R 9/06; H04R 17/00

[52] U.S. Cl. ..... 179/115.5 PS; 179/110 A; 179/116; 181/144; 181/163

[58] Field of Search ..... 179/115.5 PS, 116, 110 A, 179/115.5 R, 178, 181 R; 181/144, 163, 147

[56] References Cited

U.S. PATENT DOCUMENTS

| | | | |
|---|---|---|---|
| 1,866,831 | 7/1932 | Wolff et al. | 181/147 |
| 2,053,364 | 9/1936 | Engholm | 179/116 |
| 2,122,587 | 7/1938 | Ringel | 179/116 |
| 2,231,479 | 2/1941 | Perry | 179/115.5 R |
| 2,259,907 | 10/1941 | Olney | 179/116 |
| 2,269,284 | 1/1942 | Olson | 179/116 |
| 2,496,589 | 2/1950 | Marquis | 179/115.5 PS |
| 2,539,672 | 1/1951 | Olson et al. | 179/115,5 PS |
| 2,593,031 | 4/1952 | Howatt | 179/116 |
| 2,857,478 | 10/1958 | Harris | 179/115.5 R |
| 3,158,697 | 11/1964 | Görike | 179/115.5 PS |
| 3,796,839 | 3/1974 | Torn | 179/116 |
| 3,943,304 | 3/1976 | Piribauer | 179/111 E |
| 4,005,278 | 1/1977 | Görike | 179/180 |
| 4,146,110 | 3/1979 | Maloney | 179/115.5 PS |
| 4,182,429 | 1/1980 | Senzaki | 179/115.5 PS |
| 4,246,447 | 1/1981 | Vorie | 179/110 A |
| 4,418,248 | 11/1983 | Mathis | 179/156 R |
| 4,447,678 | 5/1984 | Fidi | 179/116 |

FOREIGN PATENT DOCUMENTS

| | | | |
|---|---|---|---|
| 830351 | 3/1960 | United Kingdom . | |
| 2063618 | 6/1981 | United Kingdom | 179/115.5 PS |

OTHER PUBLICATIONS

*Audio,* "Coaxial Speaker Assembly", Mar. 1954, vol. 38, pp. 48 and 50.

*Primary Examiner*—Gene Z. Rubinson
*Assistant Examiner*—Danita R. Byrd
*Attorney, Agent, or Firm*—Barnes & Thornburg

[57] ABSTRACT

A multi-driver loudspeaker combination includes a first transducer of the dynamic radiator type, designed to reproduce sound in the lower portion of the audio frequency range. The radiator of the first transducer includes a diaphragm. The combination also includes a second transducer designed to reproduce sound in the upper portion of the audio frequency range. A base support, which is somewhat horn-shaped, is mounted on the first transducer diaphragm, a voice coil form, or dust cap, or some combination of these, within the periphery of the first transducer diaphragm, and extends away from the first transducer. This base support terminates at an edge remote from the first transducer. The edge is in the form of a closed plane curve. The second transducer includes a diaphragm having a perimetral edge which is joined to the edge of the base support to support the second transducer from the first. This mounting structure permits orientation of the second transducer axis at an angle to the axis of the first transducer. Another multi-driver loudspeaker combination comprises the first transducer, a second transducer including a piezoelectric crystal driver, and an adhesive for gluing the piezoelectric crystal of the second transducer to the dust cap of the first transducer. Again, the axis of the second transducer can be oriented at an angle to the axis of the first transducer.

10 Claims, 11 Drawing Figures

MULTI-DRIVER LOUDSPEAKER

This is a continuation-in-part of my earlier filed, copening U.S. patent application Ser. No. 489,322, filed Apr. 28, 1983 which is a continuation-in-part of my earlier filed, copending U.S. patent application Ser. No. 383,603, filed June 1, 1982. Both are assigned to the assignee of the present invention.

This invention relates generally to loudspeaker systems, and more particularly to systems in which the audio frequency signal is divided into upper and lower ranges for higher fidelity reproduction from transducers particularly designed for that purpose. It is well known that the size, configuration, and even the operating principles of high frequency acoustic transducers may differ substantially from those of low-frequency transducers. Separate and independently operable transducers have been available for a long time, which can faithfully reproduce sound within given frequency bands. Efforts to reproduce high fidelity sound for the human ears have targeted questions such as where the frequency division should be made, how a transducer should function within its assigned frequency range, how many frequency divisions and transducers should be used, how the transducers should be physically arranged and associated with one another, and perhaps many other considerations of both broad and narrow scope.

It has been a practice for some time to provide speaker systems wherein the audio signal is divided into upper and lower frequencies and distributed to transducers particularly designed to best reproduce low or high frequency sound. It has also been common, for various reasons, to construct within a single assembly a combination of two or more transducers in which the high frequency transducer is coaxially mounted with respect to the low frequency transducer.

Coaxial loudspeakers have, in the past, employed entirely independent transducers, their interrelationship being almost entirely a matter of mechanical placement with some regard for the acoustical effects which result therefrom. Typically "coaxial" speaker systems employ one or more high frequency drivers mounted above the lower frequency system by a post or bridge-like support, and, as a result, often have irregular frequency response characteristics due to phase cancellation between the drivers and diffraction effects caused by the support apparatus.

Typical of the above features of the prior art, but by no menas all-inclusive, are U.S. Pat. Nos. 4,146,110 (Maloney); 3,796,839 (Torn); 3,158,697 (Gorike); 2,259,907 (Olney); 2,269,284 (Olson); 2,539,672 (Olson et al); 2,231,479 (Perry); and 2,053,364 (Engholm). There is also a discussion contained in Harry F. Olson, PhD, *Elements of Acoustical Engineering,* RCA Laboratories, Princeton, N.J., 1947, p. 224. Certain ones of these references incorporate to varying degrees the structures mentioned above.

It is also well known that in acoustic transducers, there are at least two types of drive mechanisms: the permanent-magnet, moving-coil type and the piezoelectric type. U.S. Pat. No. 4,246,447 (Vorie) is an example of the piezoelectric mechanism.

The speaker system of the present invention comprises a low frequency dynamic radiator type transducer or woofer and one or more higher frequency transducer(s) or tweeter(s) mounted in a single assembly, but not requiring the elaborate and costly mounting techniques of the prior art devices. The woofer unit typically is of the permanent-magnet, moving-coil configuration, its dynamic radiator being a diaphragm. The tweeter is mounted in the space defined by the aforesaid diaphragm, and comprises a smaller diameter diaphragm having situated at its apex a driver mechanism comprising a piezoelectric element, or other driving element.

In this configuration, the entire mechanism which constitutes the tweeter moves in unison with the low frequency diaphragm in the piston range and forms a part of the total moving mass of the low frequency driver. This configuration eliminates the customarily used mounting post or brackets which support the high frequency unit(s) and also improves the overall frequency response, dispersion, time, and phase characteristics of the loudspeaker system.

Accordingly, it is an object of the present invention to provide an improved multi-driver loudspeaker construction having improved overall frequency response, dispersion, and time and phase characteristics.

It is also an object of the present invention to provide an improved multi-driver loudspeaker construction which eliminates the need for a separate mounting apparatus for the mid or upper frequency driving units.

These and other objects and advantages of the present invention will be more readily apparent to those skilled in the art upon reading the following detailed description in conjunction with the accompanying drawing in which.

Figure 1:
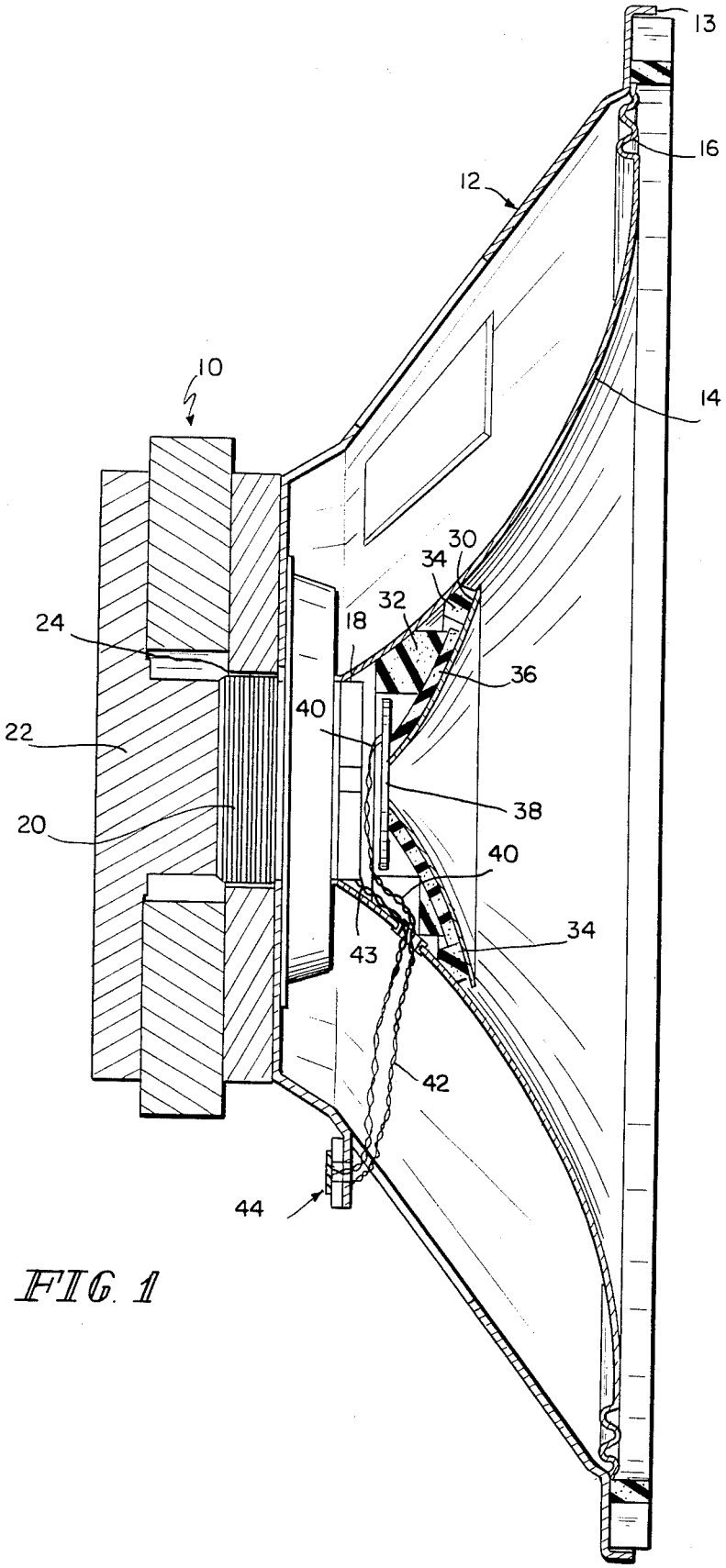
FIG. 1 is a cross-sectional view of a multi-driver loudspeaker system constructed according to the present invention.

In the embodiment of the invention illustrated in FIG. 1, the low frequency transducer or woofer is of the permanent-magnet, moving-coil type and comprises a permanent-magnet assembly 10 to which is secured a frame 12 having a generally somewhat conical configuration. The frame 12 defines an aperture 13 which defines generally the frontal shape and area of the transducer. The shape of the aperture 13 formed by the frame can be other than circular, for example, oval. The woofer diaphragm 14 extends or flares generally conically outwardly and has its outer edge secured to the periphery of the frame 12 by means of a compliant suspension 16. The inner portion of the diaphragm 14 is secured to a voice coil form 18 upon the lower portion of which is the voice coil 20 which surrounds the center pole 22 of the permanent-magnet assembly 10 with the voice coil positioned in the magnetic air gap 24 in the customary fashion. Up to this point in the description, the construction of the transducer is entirely conventional.

The high frequency transducer or tweeter comprises the tweeter cone 30, the central axis of which is aligned with the central axis of the woofer cone 14. The tweeter cone 30 has a somewhat greater flare rate and is of substantially smaller dimension than the woofer cone 14. At the outer periphery of cone 30, a foam compliance ring 34 may be positioned between the edge of cone 30 and the surface of diaphragm 14. Behind the diaphragm 30 and extending along a portion of the surface thereof, dampening or stiffening material 32 and 36 can be provided to smooth response and isolate the lead wires if desired. The driver element 38 is positioned at the apex of cone 30. This driver element 38 comprises a piezoelectric crystal commonly known in the trade as a bimorph or multimorph. The electrical leads 40 are coupled to the crystal 38, and extend out through the woofer cone 14 in conventional manner to input terminals 44 mounted upon a portion of the frame 12. The leads 40 from the crystal 38 join leads 43 which couple terminals 44 to the voice coil 20. The crystal 38 and voice coil 20 are thus electrically coupled in parallel.

The connection of the single pair of input leads to both drivers 38 and 20 without utilization of a crossover network is made possible because the crystal driver 38 functions as a high-pass filter as well as a tweeter driver, and depending upon the thickness, coupling coefficient and diameter of the crystal 38 and the diameter of cone 30 and its shape, etc., provides an effective crossover frequency in the range anywhere from one to ten kilohertz. An external filter network can be used if desired.

The damping rings 32 and 36, which illustratively can be formed of fiberglass insulating material, are to suppress undesired vibrational modes while the foam compliance ring 34 provides a means to control the mechanical coupling between the woofer and tweeter cones 14, 30 in the crossover region of response. A desirable acoustic response can thus be achieved by appropriate selection of the material, the dimensions, the symmetry, and the positon of the tweeter mechanism as well as variations in the decoupling ring 34 and damping rings 32 and 36. The tweeter cone 30 can be suspended in front of the woofer cone in several ways. The tweeter cone 30 perimeter can be attached to the woofer cone directly, or through a compliant member. The tweeter cone 30 can be suspended in front of the woofer cone, with no physical contact between the cones, by supporting the tweeter cone 30 from its crystal driver 38 and attaching the crystal driver 38 directly to the voice coil form 18 of the woofer, or to the woofer cone apex. The tweeter cone 30 can also be mounted to any suitable portion of the woofer cone 14 body, in order to provide wide angle dispersion.

When operating in response to low frequency electrical signals, the transducer assembly appears much as if it were a single piston. The operation in response to high frequency signals above the crossover frequency adds to the translational motion of the high frequency cone 30 essentially as if it were acting alone except that it is, in effect, mounted upon a support which exhibits little movement at these high frequencies. The decoupling arrangement disposed between the woofer cone 14 and tweeter cone 30 provides a method to control the degree of motion and phase between the two cones in the midband and upper band response regions, thus providing a means to control the electromechanical feedback to the tweeter driving element, as described by the reciprocity principle. This provides a smooth frequency response characteristic in the mid- and upper band response regions. This mounting arrangement between the diaphragms 14, 30 leads to improved frequency response and dispersion for the overall system and to improved time phase coherence throughout the desired frequency range. From a mechanical point of view, the arrangement of the present invention also eliminates the need for the supplemental mounting brackets customarily used in other coaxial systems to support the higher frequency drivers.

Figure 2:
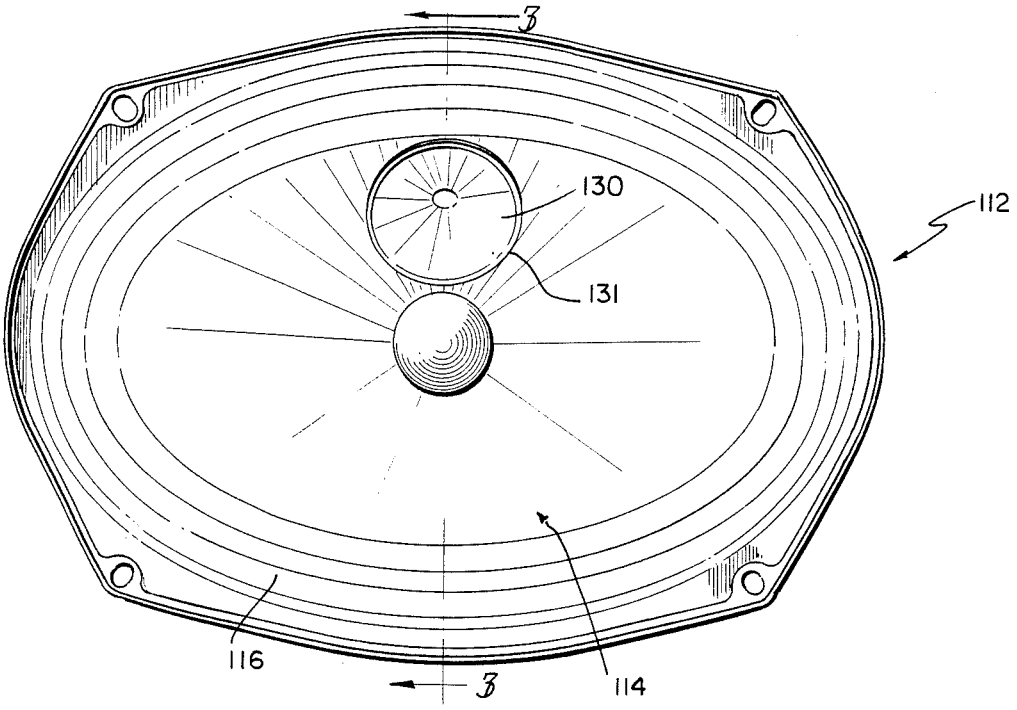
FIG. 2 is a front elevational view of a multi-driver loudspeaker system constructed according to the present invention.
Figure 3:
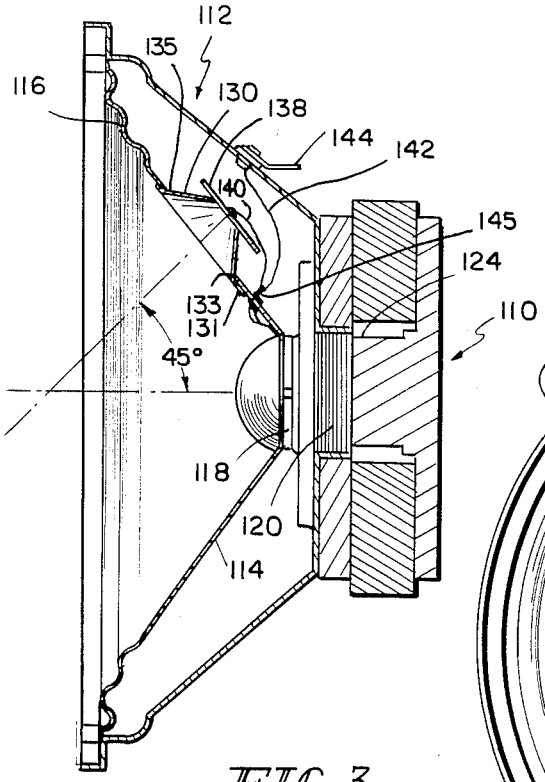
FIG. 3 is a sectional view of the system of FIG. 2, taken generally along section lines 3—3 thereof.

In another embodiment of the invention illustrated in FIGS. 2 and 3, a permanent-magnet assembly 110 is secured to a frame 112 having a generally elliptical or oval frontal opening, illustratively 6 inches by 9 inches (15.24 cm by 22.86 cm). The woofer diaphragm 114 extends generally conically outwardly. The outer rim of diaphragm 114 is secured to the oval frontal opening of the frame 112 by means of a compliant suspension 116. The inward portion of the diaphragm 114 is secured to a voice coil form 118 to which is attached a woofer voice coil 120 positioned in the magnetic air gap 124 in the customary fashion.

The tweeter of this embodiment comprises a tweeter cone 130, the central axis of which is about 45° off the axis of the woofer cone 114, as best illustrated in FIG. 3. A junction area 131 is provided at the outer perimeter of cone 130. This junction area 131 is glued or otherwise attached, with or without a compliant member, to the perimetral edge 135 of an opening 133 provided in the woofer cone 114. A piezoelectric bimorph crystal driver element 138 is positioned at the apex of cone 130. Electrical leads 140 are coupled to the crystal 138 and extend to terminals 145 provided on the outside surface of woofer cone 114. The leads 140 from the crystal 138 are coupled by leads 142 to the input terminals 144 provided on the supporting frame 112. Leads 142 also couple terminals 144 to the woofer voice coil 120. The woofer voice coil 120 and tweeter driver 138 thus are coupled in parallel.

Again, the coupling of the single pair of input leads 142 to both drivers 138 and 120 without a divider or crossover network is made possible because the crystal driver 138 acts as a high pass filter.

Figure 4:
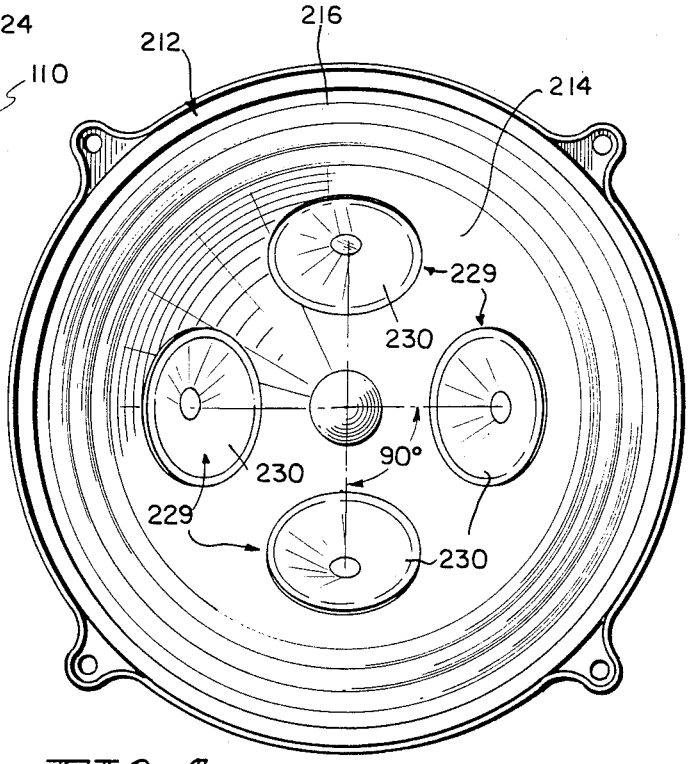
FIG. 4 is a front elevational view of a multi-driver loudspeaker system constructed according to the present invention.

In another embodiment of the invention illustrated in FIG. 4, a permanent-magnet assembly (not shown) is secured to a frame 212 having a generally circular frontal opening. The tweeter cones 230 can be molded into the woofer cone body 214, making the surrounding portion of the woofer cone 214 an extension of the tweeter cone body. A woofer diaphragm 214 flares generally conically outwardly. Its outer perimeter is secured to a circular frontal opening provided in the frame 212 by means of compliant suspension 216. The inner portion of the diaphragm 214 is secured to a voice coil form upon which is provided a voice coil which surrounds the center pole of the permanent-magnet assembly with the voice coil positioned in the air gap, all in a manner previously discussed.

Four high frequency transducers or tweeters 229 are mounted in the woofer diaphragm 214 in a manner similar to the tweeter diaphragm mounting illustrated in FIG. 3. Each tweeter 229 comprises a tweeter cone 230, the central axis of which is illustratively 45° off the central axis of the woofer cone 214, as in the embodiment of FIGS. 2 and 3. The tweeter cones' axes are also positioned at 90° intervals about the woofer cone 214 axis. As before, the tweeter cones 230 have somewhat greater flares and are of substantially smaller dimension than the woofer cone 214. A piezoelectric driver element (not shown) is positioned at the apex of each cone 230. The electrical terminations (not shown) to the crystals which drive tweeter cones 230 are made as in the preceding embodiments. Again, the crystal drivers function as high-pass filters, and the frequency responses of the drivers are selectable in part by proper selection of the physical parameters of the various drivers and tweeter cones 230.

Figure 5:
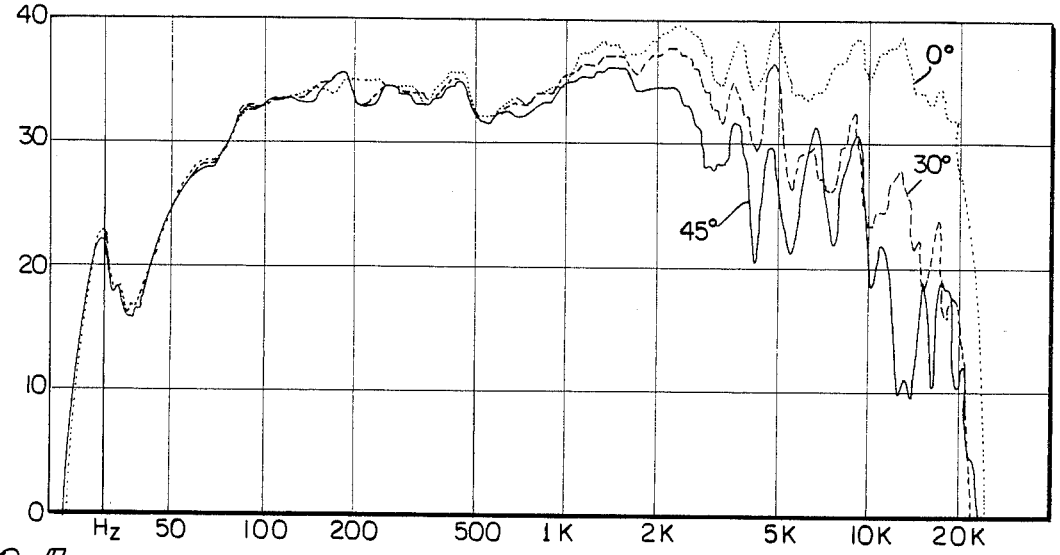
FIG. 5 PRIOR ART
FIGS. 5–7 are frequency response characteristics of a prior art speaker and two speakers constructed according to the present invention.
Figure 6:
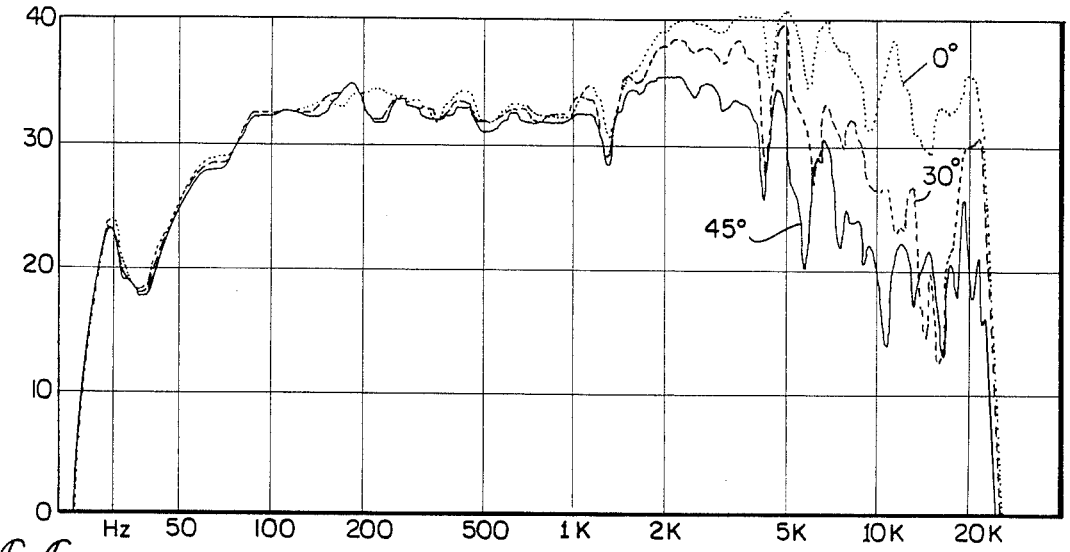
Figure 7:
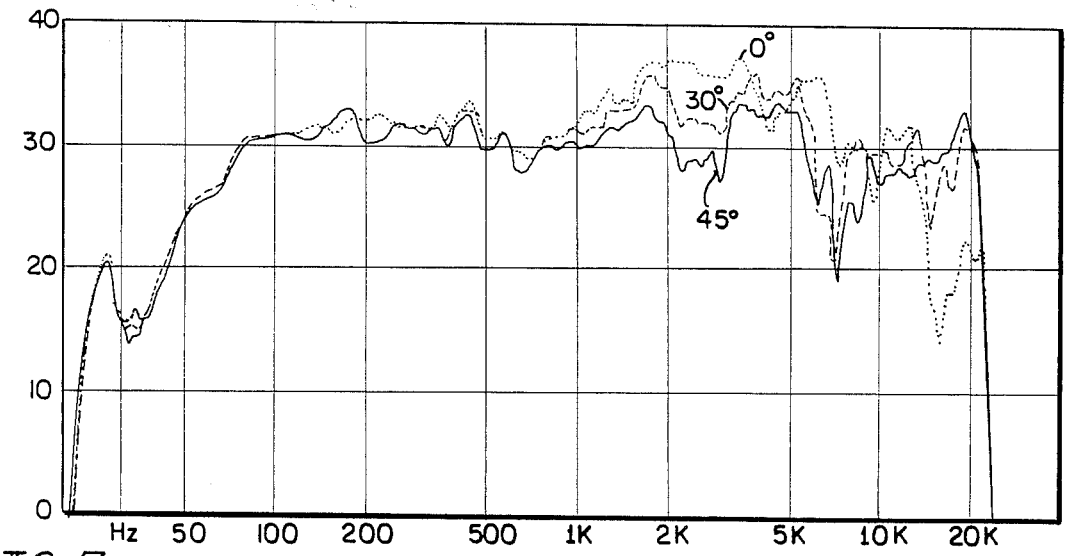

The advantages of the off-axis placement of the tweeter axes from the woofer axis in the embodiments of FIGS. 1–4 can best be appreciated with reference to FIGS. 5–7.

FIG. 5 illustrates the frequency response of a prior art 6" by 9" (15.24 cm by 22.86 cm) oval speaker with a coaxial secondary cone called a "whizzer." The three-frequency response curves correspond to the on-axis (0°) frequency response of the speaker, the 30° off-axis frequency response of the speaker, and the 45° off-axis frequency response of the speaker. It will be appreciated that, even with the whizzer cone, the off-axis (30° and 45° off-axis) response of the speaker is significantly below the on-axis response (1–3 dB) even at such low frequencies as 2 KHz. At about 4 KHz, the off-axis performance has degraded even more seriously (30° off-axis down about 5 dB, 45° off-axis down 14 dB). AT 15 KHz, 30° off-axis is down 13 dB, and 45° off-axis is down about the same amount.

FIG. 6 illustrates the frequency responses of a 6" by 9" (15.24 cm by 22.86 cm) elliptical constructed in accordance with FIG. 1. Although the off-axis response at 2 KHz remains down about 1 and 3 dB (at 30° off-axis and 45° off-axis, respectively), at 5 KHz, the 30° off-axis response is down only about 1–1.5 dB, a 3.5–4 dB improvement over FIG. 5, and the 45° off-axis response is only down 8–8.5 dB, a 5.5–6 dB improvement over FIG. 5. At 15 KHz, the improvement is equally as significant, with the 30° off-axis response being down only about 10.5 dB, a 2.5 dB improvement over FIG. 5, and the 45° off-axis only being down 8.5 dB, a 5.5 dB improvement over FIG. 5.

The frequency response characteristics of the FIGS. 2 and 3 embodiment of the invention are illustrated in FIG. 7. In the embodiment tested for FIG. 7, the apex of the tweeter cone projected into the plane of the surrounding woofer cone lay half-way from the woofer cone axis to the compliance ring. In other words, the tweeter was mounted half-way out the woofer cone from the axis to the compliance ring. At 2 KHz, the 30° off-axis response was down about 1.5–2 dB and the 45° off-axis response was down 5 dB. At 4 KHz, the 30° off-axis performance was actually 1–1.5 dB above the on-axis performance and the 45° off-axis performance was only about 1.5–2 dB lower than on-axis, both substantial improvements over the embodiment of FIG. 5. At 15 KHz, the 30° off-axis performance and 45° off-axis performance were actually both substantially above the on-axis performance with 30° being about 4–5 dB above and 45° being about 10 dB above the on-axis performance.

Figure 8:
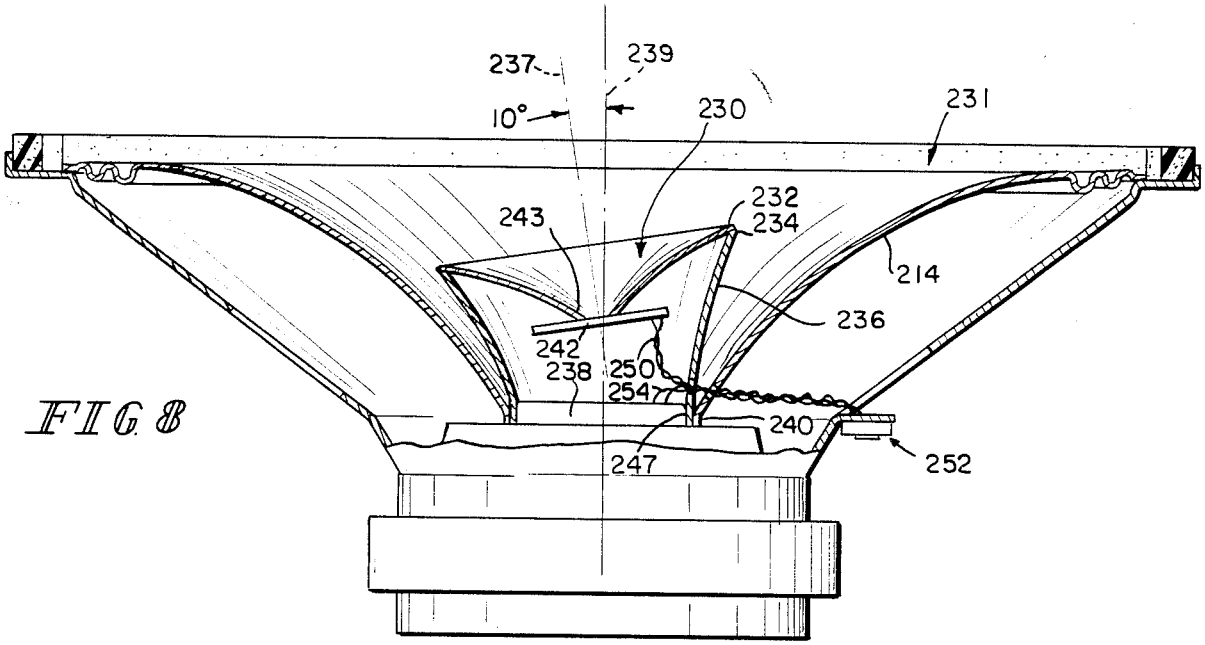
FIG. 8 is a cross-sectional view of a multi-driver loudspeaker system constructed according to the present invention.

In another embodiment of the invention illustrated in FIG. 8, the tweeter comprises a tweeter cone 230, the central axis 237 of which is tilted about 10° off the axis 239 of the woofer cone 214 in the plane of FIG. 8. In the plane perpendicular to the plane of FIG. 8 and to the mouth 231 of the woofer cone 214, the central axes 239, 237, respectively, of woofer cone 214 and tweeter cone 230 appear coaxial. The tweeter cone 230 is suspended within the woofer cone 214 by attaching the tweeter cone 230 at its edge 232 from the outer edge 234 of a light-weight base support element 236. The base support is attached at its base 247 to the woofer voice coil form 238 to lie between the woofer voice coil form 238 and the base 240 of the woofer cone 214. Attachment of woofer cone 214 base 240 to the woofer voice coil form 238 is achieved through the intermediate base support 236 base 247, e.g., by gluing. Again, the tweeter cone 230 driver is a piezoelectric crystal driver 242. The tweeter driver 242 is glued to the apex 243 of the tweeter cone 230. The tweeter driver 242 is a piezoelectric crystal which needs only to be fixed to the tweeter cone 230 to act as a transducer for high frequencies. The crystal driver 242 is a high-pass filter, so that a separate cross-over network need not be used to separate the high frequencies which drive the tweeter crystal driver 242 from the low frequencies which drive the woofer voice coil on form 238 prior to feeding the woofer voice coil and the tweeter driver 242. Such a cross-over network can be used if desired. However, in the present embodiment, the conductors 250 which feed the crystal driver 242 through the woofer cone 214 and wall of the base support 236 are coupled to the same pair of terminals 252 to which are coupled the conductors 254 attached to the voice coil on form 238.

Figure 9:
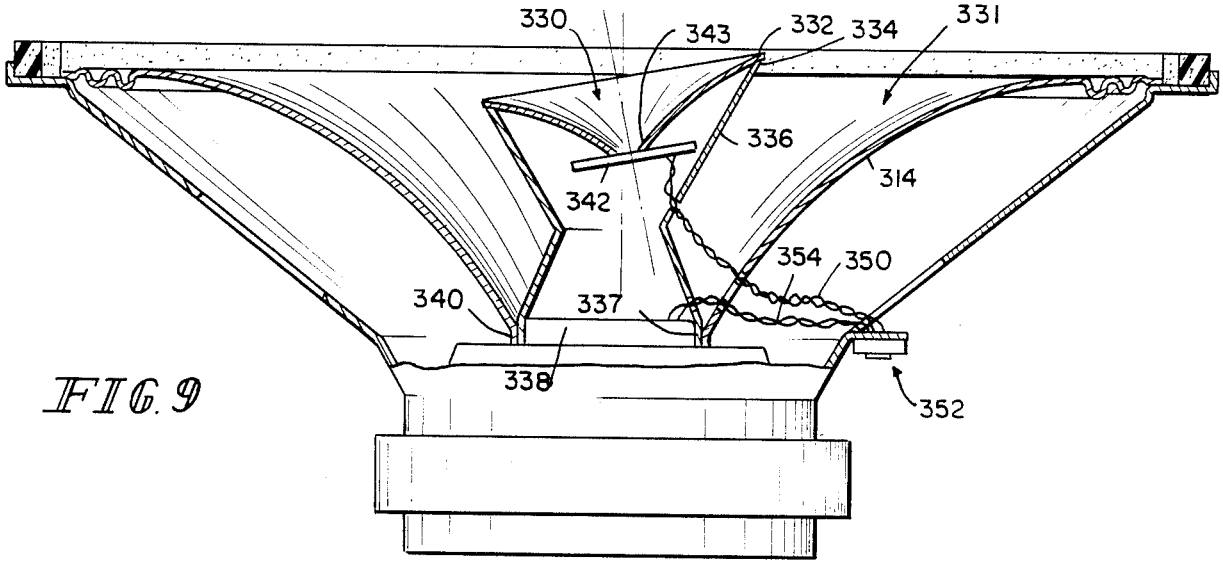
FIG. 9 is a cross-sectional view of a multi-driver loudspeaker system constructed according to the present invention.

In another embodiment of the invention illustrated in FIG. 9, the tweeter comprises a tweeter cone 330, the central axis of which is tilted about 10° off the axis of the woofer cone 314 in the plane of FIG. 9. In the plane perpendicular to the plane of FIG. 9 and to the mouth 331 of the woofer cone 314, the central axes of woofer cone 314 and tweeter cone 330 appear coaxial. The tweeter cone 330 is suspended within the woofer cone 314 by attaching the tweeter cone 330 at its edge 332 from the outer edge 334 of a base support 336. The base support 336 is attached at its base 337 to the woofer voice coil form 338 to lie between the woofer voice coil form 338 and the base 340 of the woofer cone 314. Attachment of woofer cone 314 base 340 to the woofer voice coil form 338 is achieved through the intermediate base support 336 base 337, e.g., by gluing. Again, the tweeter cone 330 driver is a piezoelectric crystal driver 342. The tweeter driver 342 is glued to the apex 343 of the tweeter cone 330. The tweeter driver 342 is a piezoelectric crystal so that it needs only to be fixed to the tweeter cone 330 to act as a transducer for high frequencies. The crystal driver 342 is a high-pass filter, so that a separate cross-over network need not be used to separate the high frequencies from the low prior to feeding the woofer voice coil on form 338 and the tweeter driver 342. Such a cross-over network can be used if desired. However, in the present embodiment, the conductors 350 which feed the crystal driver 342 through the woofer cone 314 and wall of the base support 336 are coupled to the same pair of terminals 352 to which are coupled the conductors 354 attached to the voice coil on form 338.

Figure 10:
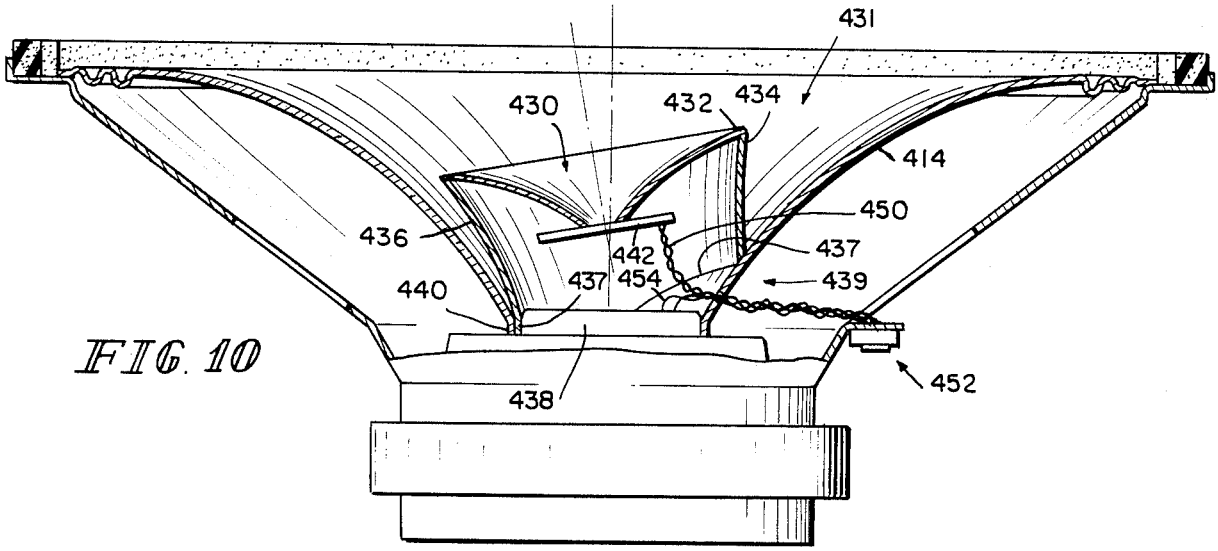
FIG. 10 is a cross-sectional view of a multi-driver loudspeaker system constructed according to the present invention.

In another embodiment of the invention illustrated in FIG. 10, the tweeter comprises a tweeter cone 430, the central axis of which is tilted about 10° off the axis of the woofer cone 414 in the plane of FIG. 10. In the plane perpendicular to the plane of FIG. 10 and to the mouth 431 of the woofer cone 414, the central axes of woofer cone 414 and tweeter cone 430 appear coaxial. The tweeter cone 430 is suspended within the woofer cone 414 by attaching the tweeter cone 430 at its edge 432 from the outer edge 434 of a base support 436. The base support is attached along part of its base 437 to the woofer voice coil form 438 to lie between the woofer voice coil form 438 and the base 440 of the woofer cone 414. Attachment of woofer cone 414 base 440 to the woofer voice coil form 438 is achieved along this part of base 414 through the intermediate base support 436 base 437, e.g., by gluing. Along another part of its base, the woofer cone 414 is secured directly to its voice coil form 438. In this region, the base support's lower edge 437 is secured, for example by gluing, to the throat region 439 of the woofer cone 414. It will be appreciated that this occurs because the perimeter of the base 437 of the base support 436 is somewhat larger than the perimeter of the base 440 of the woofer cone 414. Again, the tweeter cone 430 driver is a piezoelectric crystal driver 442. The tweeter driver 442 is glued to the apex of the tweeter cone 430. The tweeter driver 424 is a piezoelectric crystal so that it needs only to be fixed to the tweeter cone 430 to act as a transducer for high frequencies. The crystal driver 442 is a high-pass filter, so that a separate cross-over network need not be used to separate the high frequencies from the low prior to feeding the woofer voice coil on form 438 and the tweeter driver 442. Such a cross-over network can be used if desired. However, in the present embodiment, the conductors 450 which feed the crystal driver 442 through the woofer cone 414 are coupled to the same pair of terminals 452 to which are coupled the conductors 454 attached to the voice coil on form 438.

Although the embodiments of FIGS. 8–10 have all been shown with angles of 10° between the woofer axis and the tweeter axis in one plane only, it is to be understood that the angular orientation between these axes is determined largely by the needs of a particular application. The high-frequency acoustical output of the tweeter is more directional than that of the woofer. Therefore, the angle between the axes of the woofer and tweeter may be determined by, among other criteria, where in front of the multi-driver loudspeaker the high frequencies are to be heard.

Figure 11:
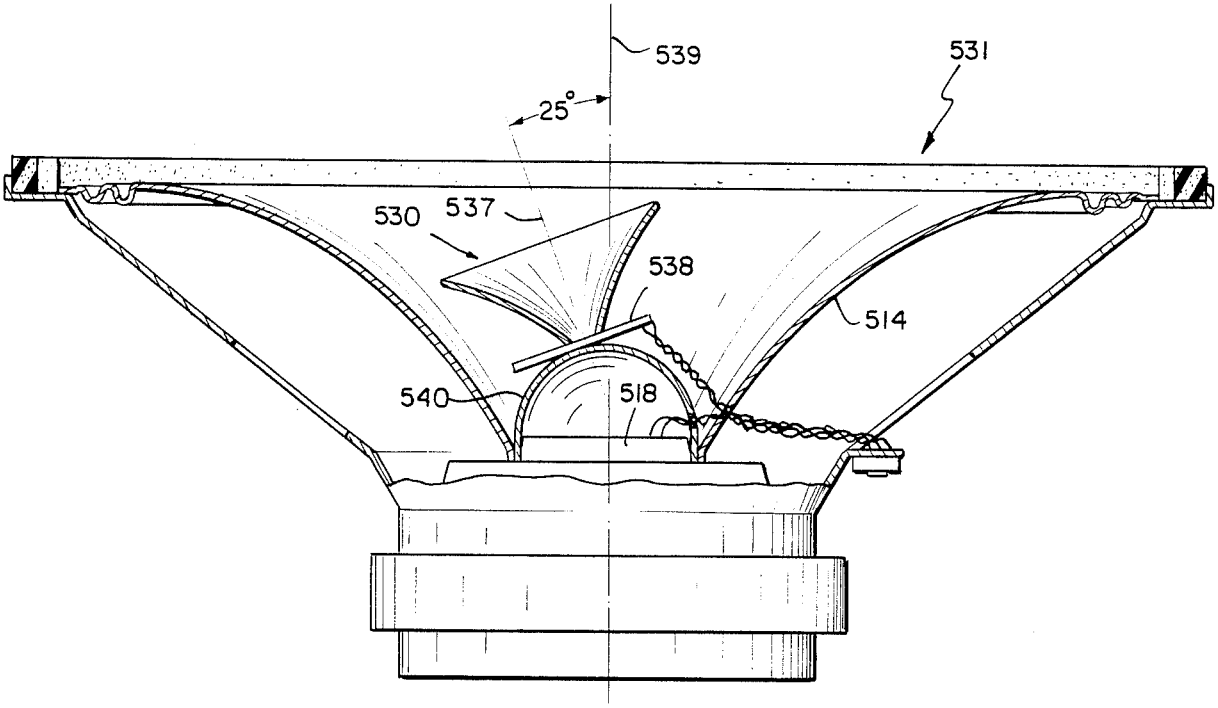
FIG. 11 is a cross-sectional view of a multi-driver loudspeaker system constructed according to the present invention.

In another embodiment of the invention illustrated in FIG. 11, the tweeter comprises a tweeter cone 530, the central axis 537 of which is tilted about 25° off the axis 539 of the woofer cone 514 in the plane of FIG. 11. In the plane perpendicular to the plane of FIG. 11 and to the mouth 531 of the woofer cone 514, the central axes 539, 537, respectively, of woofer cone 514 and tweeter cone 530 appear coaxial. The tweeter cone 530 is suspended in front of the woofer cone 514, with no physical contact between the cones 514, 530, by attaching the tweeter cone 530 to its crystal driver 538 and attaching the crystal driver 538 to the dust cap 540 which covers the voice coil form 518 of the woofer. The dust cap 540 prevents the entry of dust into the air gap (not shown) between the voice coil and the permanent magnet's center pole piece which the voice coil form 518 surrounds. The crystal driver 538 is attached to the dust cap 540 by any suitable means, such as an adhesive.

What is claimed is:

1. A multi-driver loudspeaker combination comprising a first transducer of the dynamic radiator type designed to reproduce sound in the lower portion of the audio frequency range, the radiator of the first transducer including a diaphragm, a second transducer designed to reproduce sound in the upper portion of the audio frequency range, said second transducer being positioned within the periphery of the said diaphragm, and means for mounting the second transducer, the mounting means consisting essentially of a base support, means for mounting the base support from the first transducer radiator to extend away from the first transducer, the base support terminating at an edge, the second transducer including a diaphragm having an edge joined to the first-mentioned edge to support the second transducer from the base support.

2. The loudspeaker combination of claim 1 wherein the base support edge and the diaphragm edge are closed generally planar curves.

3. The loudspeaker combination of claim 1 wherein the second transducer includes driving means comprising a piezoelectric crystal.

4. The loudspeaker combination of claim 1 wherein each of the first and second transducers includes separate driving means, the driving means of the first transducer being of the moving coil, permanent magnet type, the driving means of the second transducer being of the piezoelectric type.

5. The loudspeaker combination of claim 4 wherein the second transducer is mounted non-concentrically with respect to the first transducer.

6. The loudspeaker combination of claim 1 wherein the second transducer is mounted non-concentrically with respect to the first transducer.

7. The loudspeaker combination of claim 1 wherein the first transducer axis and the second transducer axis are angularly displaced from each other.

8. A multi-driver loudspeaker combination comprising a first transducer of the dynamic radiator type designed to reproduce sound in the lower portion of the audio frequency range, the radiator of the first transducer including a diaphragm, a second transducer designed to reproduce sound in the upper portion of the audio frequency range, said second transducer being positioned within the periphery of the said diaphragm, each of the first and second transducers including separate driving means, the driving means of the first transducer being of the moving coil, permanent magnet type, the driving means of the second transducer being of the piezoelectric type, and a base support for mounting the second transducer from the first transducer radiator to extend away from the first transducer, the base support comprising a dust cap covering a central region of the first transducer, and a suitable adhesive for mounting the piezoelectric driver from the dust cap.

9. The loudspeaker combination of claim 8 wherein the piezoelectric driver axis and the moving coil axis are angularly displaced from each other.

10. In a multi-driver loudspeaker combination comprising a first transducer of the dynamic radiator type designed to reproduce sound in the lower portion of the audio frequency range, the first transducer including a dust cap, a second transducer designed to reproduce sound in the upper portion of the audio frequency range, said second transducer including a second transducer diaphragm and a piezoelectric driver, and means for mounting the second transducer from the first transducer consisting essentially of an adhesive for mounting the piezoelectric driver from the dust cap.

* * * * *